US007827752B2

(12) United States Patent
Scherrer

(10) Patent No.: US 7,827,752 B2
(45) Date of Patent: Nov. 9, 2010

(54) INSULATING CONCRETE FORM HAVING LOCKING MECHANISM ENGAGING TIE WITH ANCHOR

(75) Inventor: Edward Scherrer, Albuquerque, NM (US)

(73) Assignee: APS Holdings, LLC, Portland, OR (US)

( * ) Notice: Subject to any disclaimer, the term of this patent is extended or adjusted under 35 U.S.C. 154(b) by 918 days.

(21) Appl. No.: 11/618,980

(22) Filed: Jan. 2, 2007

(65) Prior Publication Data

US 2008/0022619 A1 Jan. 31, 2008

Related U.S. Application Data

(60) Provisional application No. 60/758,241, filed on Jan. 11, 2006.

(51) Int. Cl.
*E04B 2/86* (2006.01)

(52) U.S. Cl. ..... 52/426; 52/309.12

(58) Field of Classification Search ..... 52/309.11, 52/309.12, 405.9, 426, 309.9, 309.15, 309.17, 52/442

See application file for complete search history.

(56) References Cited

U.S. PATENT DOCUMENTS

| | | | | | |
|---|---|---|---|---|---|
| 510,720 | A | * | 12/1893 | Stewart | 52/279 |
| 1,345,156 | A | * | 6/1920 | Flynn | 52/258 |
| 1,953,287 | A | * | 4/1934 | Bemis | 52/428 |
| 2,316,819 | A | * | 4/1943 | Tedrow | 52/564 |
| 2,326,361 | A | * | 8/1943 | Jacobsen | 52/427 |
| 2,647,392 | A | * | 8/1953 | Wilson | 52/563 |
| 3,992,844 | A | * | 11/1976 | Gretter | 52/426 |
| 4,223,501 | A | * | 9/1980 | DeLozier | 52/309.12 |
| 4,229,920 | A | * | 10/1980 | Lount | 52/309.12 |
| 4,285,181 | A | * | 8/1981 | Van Loghem et al. | 52/405.4 |
| 4,439,967 | A | * | 4/1984 | Dielenberg | 52/309.12 |
| 4,765,109 | A | * | 8/1988 | Boeshart | 52/426 |
| 4,889,310 | A | * | 12/1989 | Boeshart | 249/41 |
| 5,209,039 | A | * | 5/1993 | Boeshart | 52/699 |
| 5,321,926 | A | * | 6/1994 | Kennedy | 52/405.1 |
| 5,337,530 | A | * | 8/1994 | Beames | 52/426 |
| 5,390,459 | A | * | 2/1995 | Mensen | 52/426 |
| 5,459,971 | A | * | 10/1995 | Sparkman | 52/426 |
| 5,625,989 | A | * | 5/1997 | Brubaker et al. | 52/309.12 |
| 5,701,710 | A | * | 12/1997 | Tremelling | 52/426 |
| 5,704,180 | A | * | 1/1998 | Boeck | 52/426 |

(Continued)

FOREIGN PATENT DOCUMENTS

AT 007060 U1 9/2004

OTHER PUBLICATIONS

Extended European search and opinion, EP Appl. No. 07873295.5, Apr. 23, 2009.

*Primary Examiner*—Michael Safavi
*Assistant Examiner*—Joshua Rodden
(74) *Attorney, Agent, or Firm*—Townsend and Townsend and Crew, LLP

(57) ABSTRACT

A knocked-down insulating concrete form including two spaced apart lightweight panels maintained in position by a tie assembly. The tie assembly including a pair of vertically elongated anchors which are each attached to one of the two panels, and a tie engaging the anchors to maintain the panels in spaced apart relation. The tie engaging the anchors via a slideable locking mechanism for selectively preventing slideable movement between the tie and the anchors.

16 Claims, 14 Drawing Sheets

U.S. PATENT DOCUMENTS 5,735,093 A * 4/1998 Grutsch ..... 52/309.11
5,809,727 A * 9/1998 Mensen ..... 52/426
5,809,728 A * 9/1998 Tremelling ..... 52/426
5,896,714 A * 4/1999 Cymbala et al. ..... 52/426
5,983,585 A * 11/1999 Spakousky ..... 52/405.4
5,992,114 A * 11/1999 Zelinsky et al. ..... 52/426
6,230,462 B1 * 5/2001 Beliveau ..... 52/426
6,240,692 B1 * 6/2001 Yost et al. ..... 52/426
6,314,694 B1 * 11/2001 Cooper et al. ..... 52/309.12
6,318,040 B1 * 11/2001 Moore, Jr. ..... 52/426
6,401,419 B1 * 6/2002 Beliveau ..... 52/592.6
6,412,245 B1 * 7/2002 Lane et al. ..... 52/586.1
6,438,918 B2 * 8/2002 Moore et al. ..... 52/426
6,526,713 B2 * 3/2003 Moore, Jr. ..... 52/309.11
6,536,172 B1 * 3/2003 Amend ..... 52/426
6,609,340 B2 * 8/2003 Moore et al. ..... 52/309.11
6,647,686 B2 * 11/2003 Dunn et al. ..... 52/426
6,668,503 B2 * 12/2003 Beliveau ..... 52/426
6,792,729 B2 * 9/2004 Beliveau ..... 52/426
6,820,384 B1 * 11/2004 Pfeiffer ..... 52/426
6,935,081 B2 * 8/2005 Dunn et al. ..... 52/426
6,978,581 B1 * 12/2005 Spakousky ..... 52/405.4
7,032,357 B2 * 4/2006 Cooper et al. ..... 52/426
7,082,731 B2 * 8/2006 Patz et al. ..... 52/426
7,082,732 B2 * 8/2006 Titishov ..... 52/426
7,347,029 B2 * 3/2008 Wostal et al. ..... 52/426
7,409,801 B2 * 8/2008 Pfeiffer ..... 52/426
7,415,804 B2 * 8/2008 Coombs et al. ..... 52/426
2001/0027630 A1 10/2001 Moore, Jr. et al.
2005/0028466 A1 2/2005 Titishov
2005/0028467 A1 2/2005 Bentley

* cited by examiner

INSULATING CONCRETE FORM HAVING LOCKING MECHANISM ENGAGING TIE WITH ANCHOR

CROSS-REFERENCE TO RELATED APPLICATION

This application claims the benefit of the filing of U.S. Provisional Application Ser. No. 60/758,241, entitled Insulating Concrete Form filed on Jan. 11, 2006 and the specification thereof is incorporated herein by reference.

BACKGROUND OF THE INVENTION

The use of Insulating Concrete Forms (ICFs) is well accepted as a superior building construction technology. Briefly, an ICF is an expanded plastic, usually polystyrene, form comprising two spaced apart panels. The forms are assembled into a hollow vertical wall into which concrete is poured thereby creating a concrete wall. Unlike wood or steel forms, the ICF remains in place and becomes a permanent part of the building providing insulation that contributes to energy efficiency, lower noise, and environmentally responsible practices. There are a large number of design considerations for ICFs not the least of which is ease in constructing the hollow vertical wall with minimum labor costs.

Another consideration for the design of an ICF includes the overall size of the form. The larger the size of the form, the less number of forms are required to build a wall of a certain height and width and thus less labor is required to assemble the forms into the hollow vertical wall. However, because of the bulk of ICFs, in general, a countervailing consideration with respect to the size of the form is the shipping costs. Concrete walls constructed using ICFs may be anywhere from four inches in thickness to 24 inches in thickness. Typical wall thicknesses are 4, 6, 8 and 10 inches. In a typical ICF, the panel may be on the order of several inches of thickness. The panels are typically rectangular with the longer axis of the form horizontally oriented. A form manufactured and sold by American Polysteel, LLC, located in Albuquerque, N.M. is two feet high and four feet wide. It will therefore be seen that if a form is shipped ready to use, the overall form may be 2×4 feet (height and width) and between 10 and 30 inches in thickness depending upon the thickness of the concrete wall to be constructed. Thus, the volume of the form may be on the order of from 8 to 20 cubic feet. Since shipping costs are in part based upon the volume (as opposed to the weight) of the freight, one way of reducing the volume of the form is to ship the form in a "knocked-down" condition and assembling the form on site. An example of a knock-down flat panel form is shown in FIG. 1.

When panels are shipped in a knocked-down condition, the panels are assembled by inserting a structural member between the two panels to hold the panels in spaced apart relation during pouring of the concrete. After the concrete has set, the structural member is embedded in the concrete and thus holds the panels in snug relation to the faces of the concrete wall. These structural members are referred to in the ICF industry as "ties." Ties may be of a wide variety of designs and construction including different types of material. The term "tie" is therefore a generic term for an object that provides the function of maintaining the panels in spaced apart relation.

There are various desirable features in a well-designed ICF tie used in a knocked-down form. The tie must be appropriately anchored in the panels so as to maintain the panels in the desired position thereby defining the thickness of the concrete wall. As wet concrete is poured, the concrete, particularly on the forms at the lowest level of the hollow wall, subjects the tie to considerable force by pushing the two panels away from one another. The tie assembly, defined as the combination of the tie and the anchor members secured to the panels must be capable of withstanding these considerable forces without separating, i.e., rupturing the integrity of the wall. It is also desirable to provide ties that can be used to support horizontal reinforcing bars (rebars) that are embedded in the concrete wall. The ties may be of various material as may be chosen by one having ordinary skill in the art. It is also desirable that the knocked-down type of ICF can be quickly and easily assembled at the job site. Still another consideration is that the ties which engage the anchors in the opposed panels during assembly of the form at the job site is relatively foolproof so as to avoid errors, such as improper tie insertion into the anchors in a manner such that the tie and anchors inadvertently become disengaged while concrete is poured.

None of the ties in the prior art provide some or all of these features.

SUMMARY OF THE INVENTION

This invention provides an insulating concrete form comprising a pair of opposed wall panels each of which is formed of a lightweight material and which are arranged in spaced apart relation. Each panel has an interior and exterior surface, upper and lower edges, and right and left ends. The form includes at least two vertically disposed tie assemblies, each of which includes, a pair of vertically elongated anchors, each anchor vertically oriented, and fixedly attached to one of the two panels. Each anchor comprises a vertically extending first engagement element arranged so that it is exposed on the interior surface of the panel. The anchor additionally includes a vertically elongated and oriented furring strip arranged so as to be at least adjacent to the exterior surface of the panel. The elongated member engagement element and the furring strip are connected. A vertically extending spacing member, a tie, includes a pair of second engagement elements, removably engaging the first engagement element of each of the anchor elongated members thereby maintaining the panels in spaced apart relation. The tie assembly may (but not necessarily) include a slidable locking sub-assembly.

DETAILED DESCRIPTION OF EMBODIMENTS OF THE INVENTION

Figure 1:
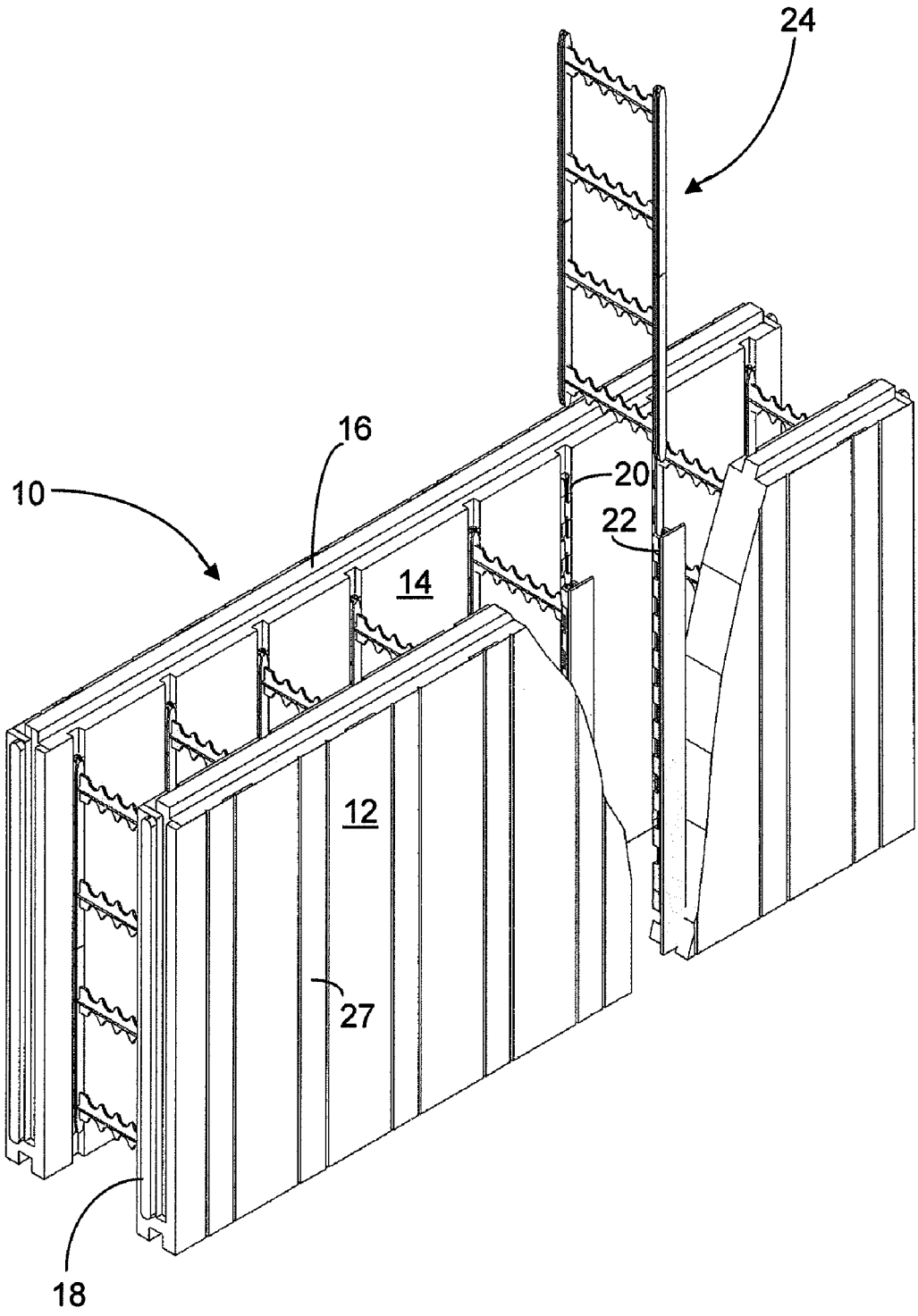
FIG. 1 is an isometric view of one embodiment of an insulated concrete form.

FIG. 1 illustrates one embodiment of an ICF in a fully assembled condition except for one tie which is positioned above the form in readiness for assembly into the form. The form 10 comprises a first panel 12 and a second panel 14 shown in spaced-apart relationship so as to define an inner space and constructed of lightweight material such as expanded polystyrene. Each panel has an upper edge 16 and a lower edge (not shown). Each panel also has an end 18 and an opposite end (not shown). The ends and/or upper and lower edges of each panel may be provided with a tongue and groove design so that the panels may be interlocked as the hollow wall comprising multiple ICFs is built.

A tie assembly comprises a pair of anchors 20, 22 fixedly attached to the respective panels as by embedding the anchors in the panel walls during formation of the panels. It will be understood by those having ordinary skill in the art that the anchors may protrude inwardly from the panel inner surface or may be deeply embedded in the panel. The tie assembly also includes a tie shown generally at 24. As seen in FIG. 1, there may be a plurality and preferably at least two tie assemblies that maintain the panels 12, 14 in spaced relation. The number of tie assemblies depends upon the height and width of the panels as well as the thickness of the wall to be poured.

Figure 2:
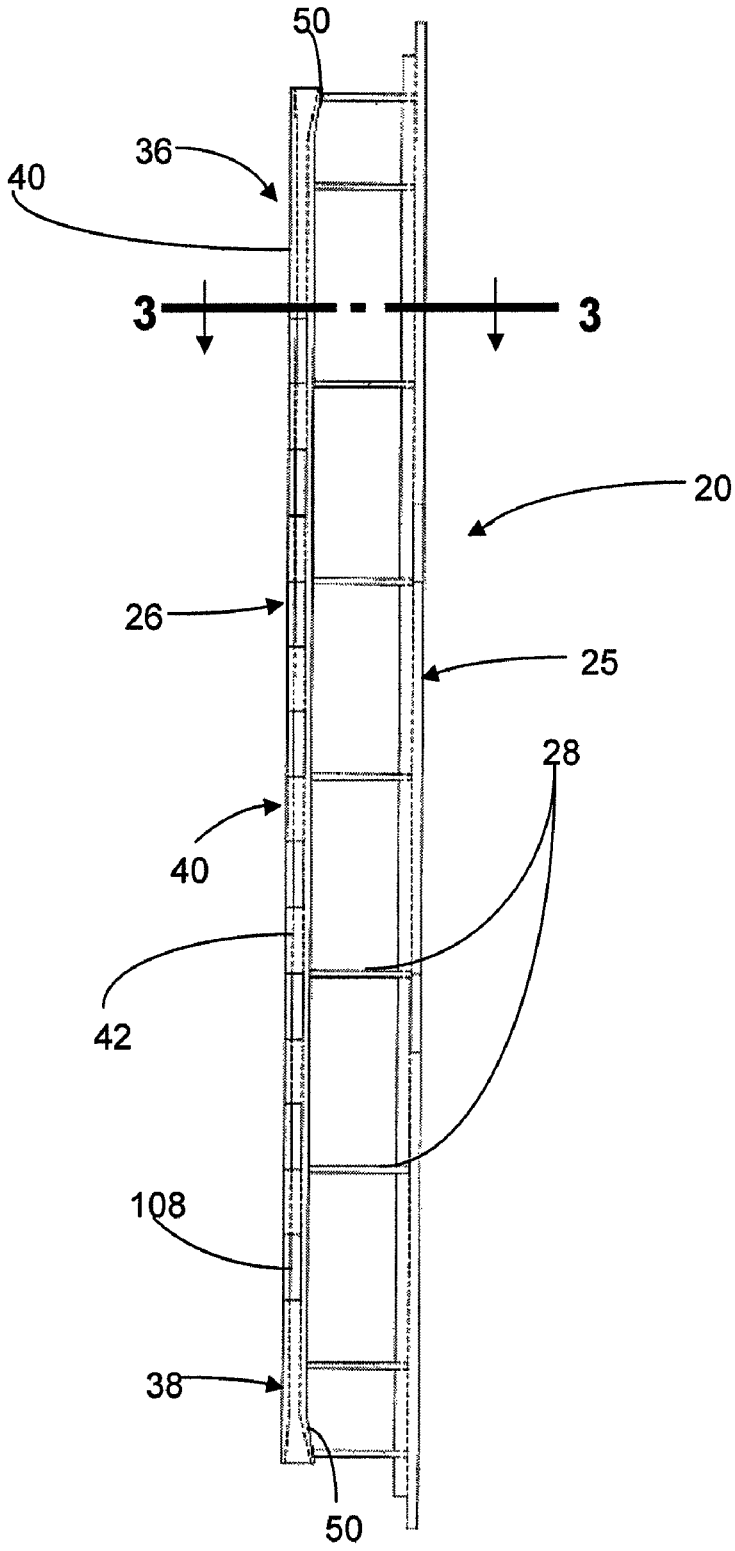
FIG. 2 is a side elevation view of one embodiment of an anchor that is part of the tie assembly.
Figure 3:
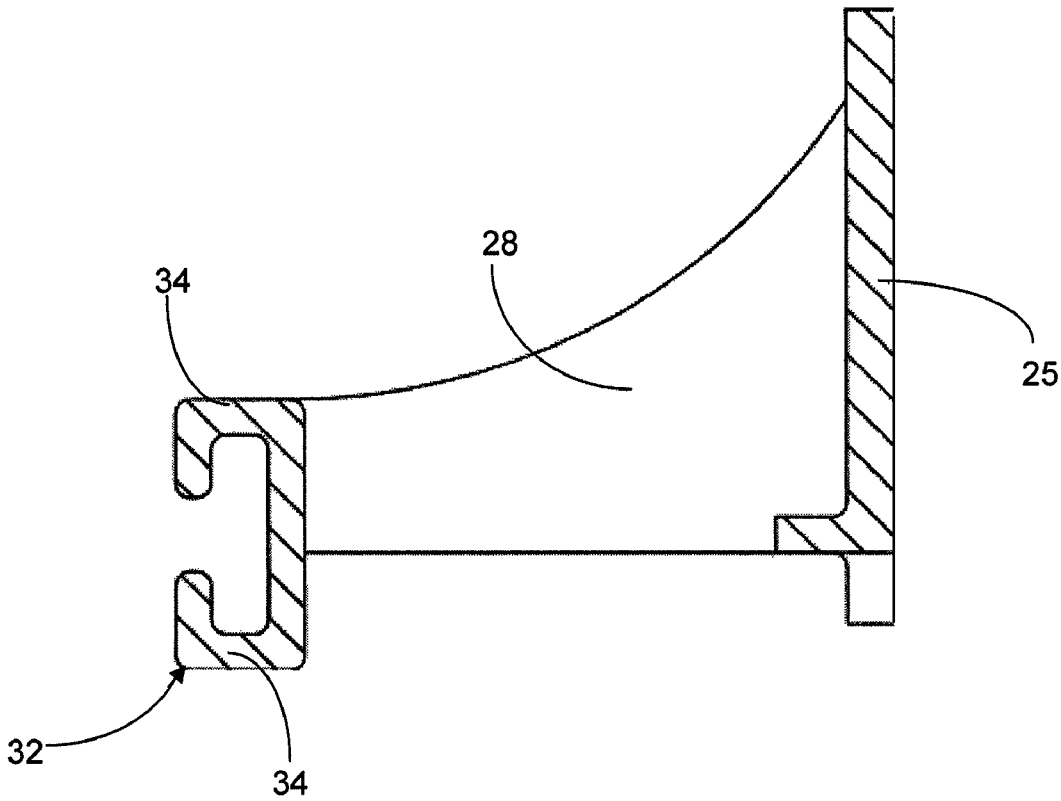
FIG. 3 is a cross-sectional view taken along the plane 3-3 of FIG. 2.
Figure 4:
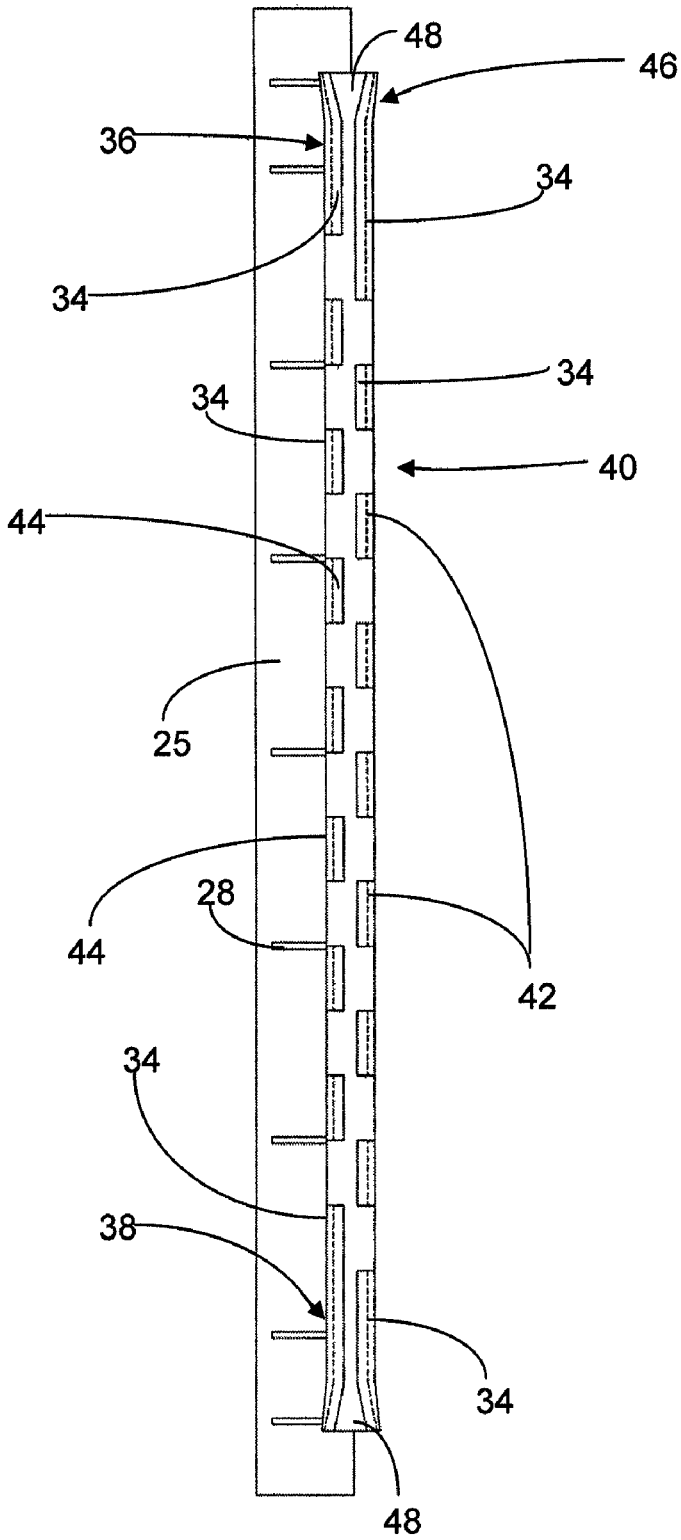
FIG. 4 is a front elevation view of the anchor shown in FIG. 3.

The anchor embodiment forming part of the tie assembly is shown in FIGS. 2, 3 and 4. Anchors 20 and 22 are identical and only one of the anchors will be described in detail with reference to FIGS. 2-4. As shown in FIG. 2, the anchor 20 includes two elongated members, a furring strip 25, and an engaging, connecting or holding member or element 26. The furring strip 25 and engaging element 26 are connected through one or more webs or stiffener elements 28 or may be integral. In the embodiment of FIG. 2, there are nine webs or stiffeners vertically disposed in spaced relation along the entire length of anchor 20. As will be apparent to those skilled in the art, elongated members 25 and 26 may be connected with a single or several web stiffeners so as to maintain the engaging member 26 in spaced relation to the furring strip 25 while functioning to transfer the load from objects attached to the furring strip (as described below) to the engaging element 26 which attaches to the tie when the insulating concrete form is fully assembled.

Furring strip 25 comprises an elongated flat plate or strip of material. As seen in FIG. 1, when the anchor is embedded in the panel 12, the furring strip 25 outer surface is inset from the outer surface of the panel and is covered by the expanded polystyrene panel material. It may be desirable to have the furring strip 25 at the surface of the panel such that after construction of the concrete wall, the position of the furring strips can be easily identified. Alternatively, when the furring strip 25 is embedded in the panel and spaced adjacent to the panel outer surface, the panel may have lines 27 impressed in the panels to show the position of the embedded furring strip. One advantage of insetting the furring strips is to allow a channel to be formed in the outer surface of the panel by use of a hot knife to allow objects, such as conduit, to be inserted in the channels. The furring strip is made of a material and thickness that can receive fasteners. The function of the furring strip is to allow an external covering to be applied to the outer surface of the panel after the wall is fully constructed. For example, it may be desirable to attach, where the concrete wall is an exterior wall of the building, external siding to the completed wall with fasteners attached to the furring strips. As another alternative, the exterior surface of the building may be stucco and thus a screen or web material on which the stucco is applied may be attached to the furring strips. On the interior side of a concrete wall of a building, the surface may be covered with standard plasterboard that may be secured to the wall with fasteners driven into the furring strips. There are many other uses for the furring strips and ways of attaching objects to the panels as is well known in the art.

In the embodiment of an anchor shown in FIGS. 2-4, the engaging element 26 may have a "C" cross-section so as to form a C-channel elongated engagement element 32 as seen best in FIG. 3. The C-channel 32 has a pair of arms 34 at selected vertical sections of the C-channel. As seen in FIG. 4, the C-channel elongated engaging element 32 has an upper section indicated generally at 36, a lower section indicated generally at 38, and a center section indicated generally at 40. The center section 40 comprises a plurality of arm sections 42. The C-channel 32 is thus discontinuous along its length such that an arm section 42 on the left side (as viewed in FIG. 4) has no corresponding arm on the opposite edge but immediately above and below arm section 42 there is an arm section 44 on the right hand edge of channel 32 with no corresponding arm on the opposing edge. The purpose of the discontinuous C-channel, such that the two arms are opposed at the top and bottom sections 36 and 38, but not in the center section 40, where they are unopposed as shown for arm sections 42 and 44 is to permit deflection of the arms as the runner of the tie (to be described) enters and is slidably forced along the length of the C-channel during installation to thereby reduce resistance between the runner and C-channel as the tie is slid into the anchor 20.

The upper section 36 of anchor 20 has opposed walls 34 to define a complete "C" section. At the upper end of section 36 the opening between arms 34 is widened as shown at section 46 such that there is provided, as seen in the front view of FIG. 4, a V-shaped opening 48. The lower section 38 also includes a widened portion 46 that also defines a V-shaped opening 48. The purpose of the widened portion 46 of the upper and lower sections 36, 38 is to facilitate entry of the tie runner into the C-channel elongated member 32. It is to be noted that the right hand arm 34 in section 36 of the anchor 20 extends lower than the opposed arm 34 by a distance that is approximately equal to the vertical spacing between adjacent arm sections 42. At the lower section 38, the left hand arm extends further upwardly than the right hand arm 34 so as to be complementary to the arrangement of the arms in upper section 36. The flared arms 34 at sections 36, 38 increase the width of the opening of the C-channel to more easily receive the tie. Additionally, as seen best in FIG. 2, the depth of the C-channel is increased at 50 in both the top and bottom sections 36 and 38 so as to more easily receive the tie.

Figure 5:
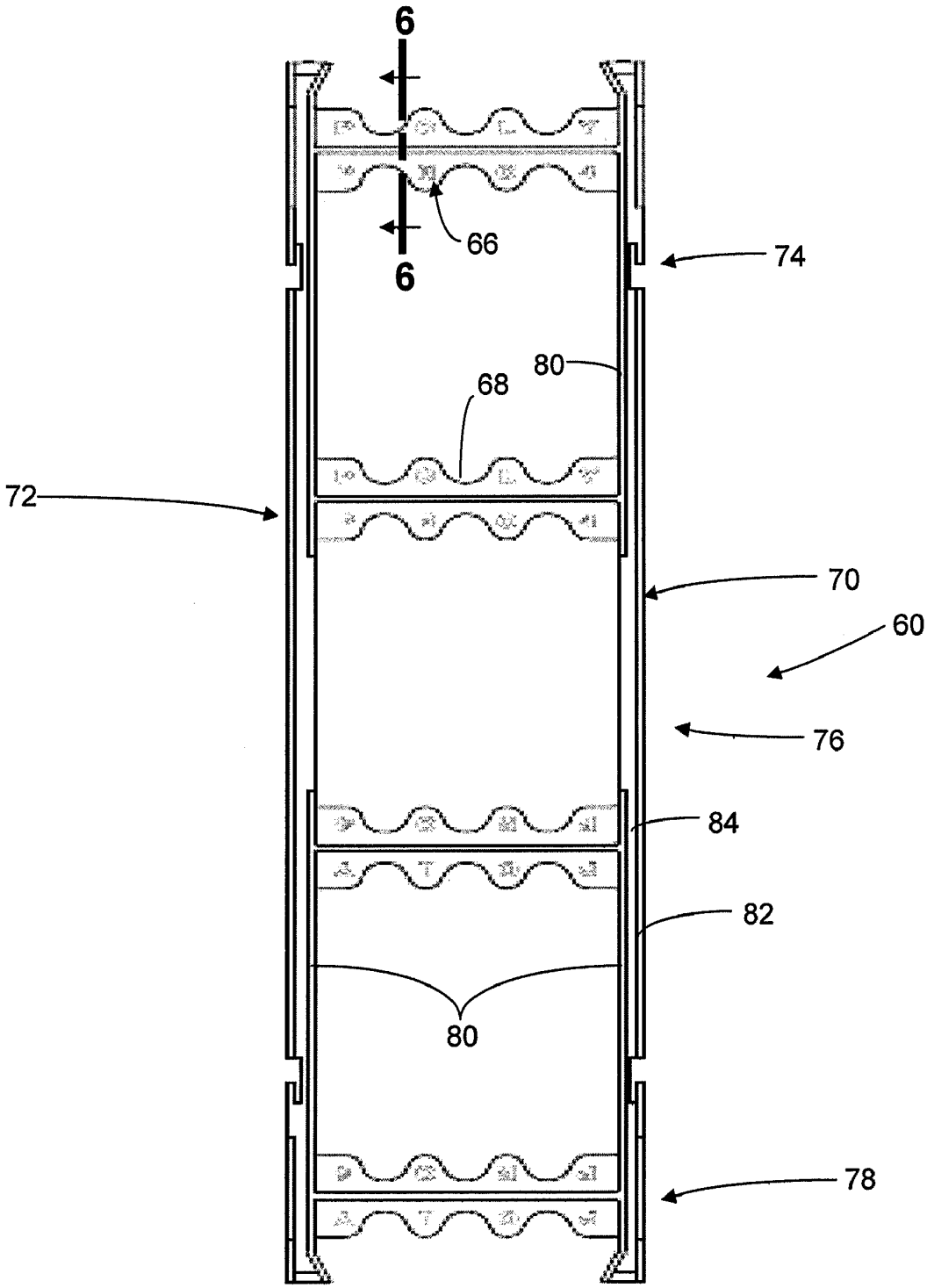
FIG. 5 shows one embodiment of a tie that is part of the tie assembly.
Figure 6:
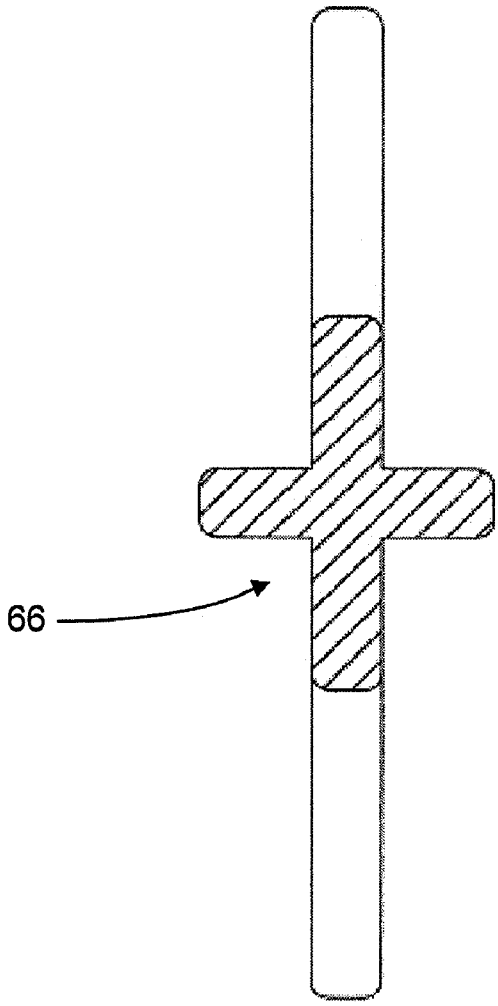
FIG. 6 is a cross-sectional view taken along the plane 6-6 in FIG. 5.

An embodiment of a tie 60 suitable for selectively interconnecting the anchors (which together comprise the tie assembly) is shown in FIGS. 5 through 8. A front view of tie 60 is shown in FIG. 5. Tie 60 is vertically elongated and includes a pair of rails 70, 72 interconnected by spacing members 66. Each rail comprises an inner runner 80 and an outer runner 82. The inner and outer runners 80, 82 are connected by a web 84 as seen best in FIG. 8. The outer runner 82 comprises an engagement element by virtue of its T-shaped cross section, as explained more fully below. The spacing members 66 include depressions or notches 68 which when the insulating concrete form is assembled to form a hollow wall, provides horizontal supports for reinforcing bars that will be embedded in the concrete wall upon completion of the wall. The spacing members 66 have a cross section as shown in FIG. 6. The tie 60 has an upper section 74, a middle section 76, and a lower section 78. Upper and lower sections 74, 78 are identical but are inverted. As will be seen in FIG. 5, the upper and lower sections 74 and 78 have a cross-section that is I-shaped; the middle section 76 has a T-shaped cross-section. Removal of the inner runner in middle section 76 facilitates slidable movement of the runners of tie 60 when inserted into C-channel 32 of anchors 20, 22.

Figure 7:
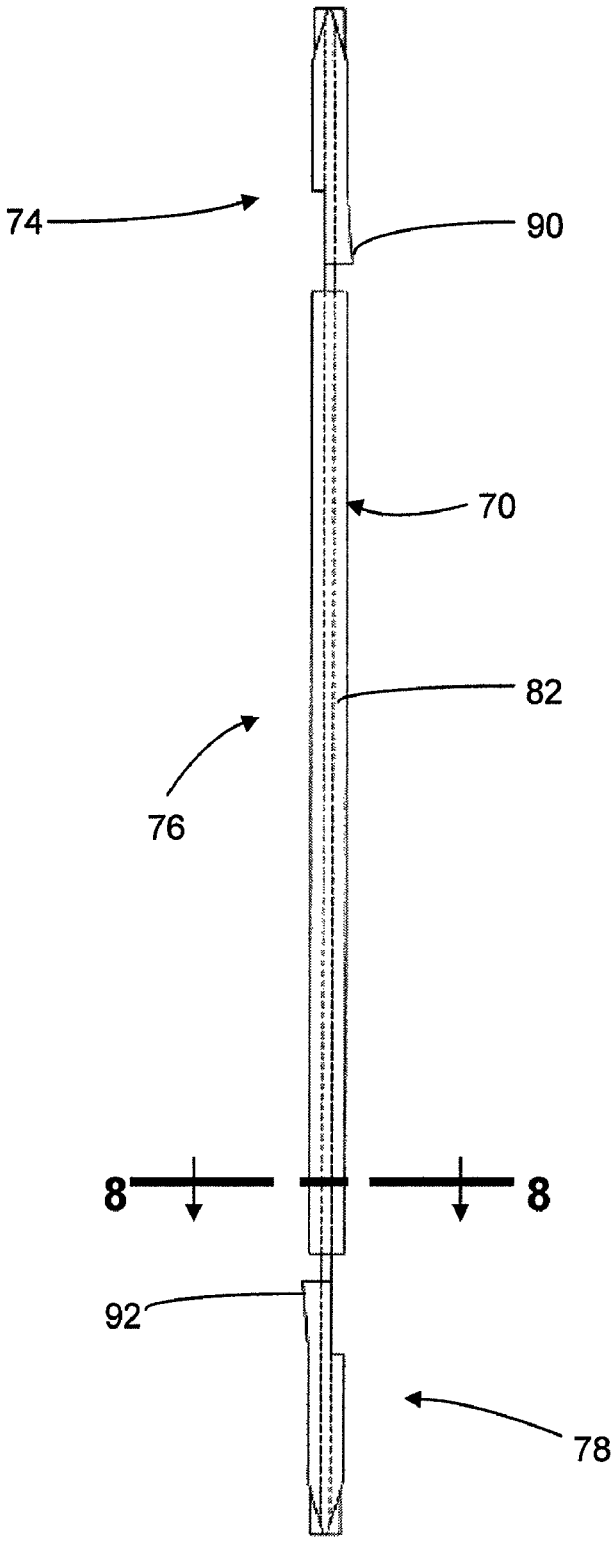
FIG. 7 is a side elevation view of the tie shown in FIG. 5.
Figure 8:
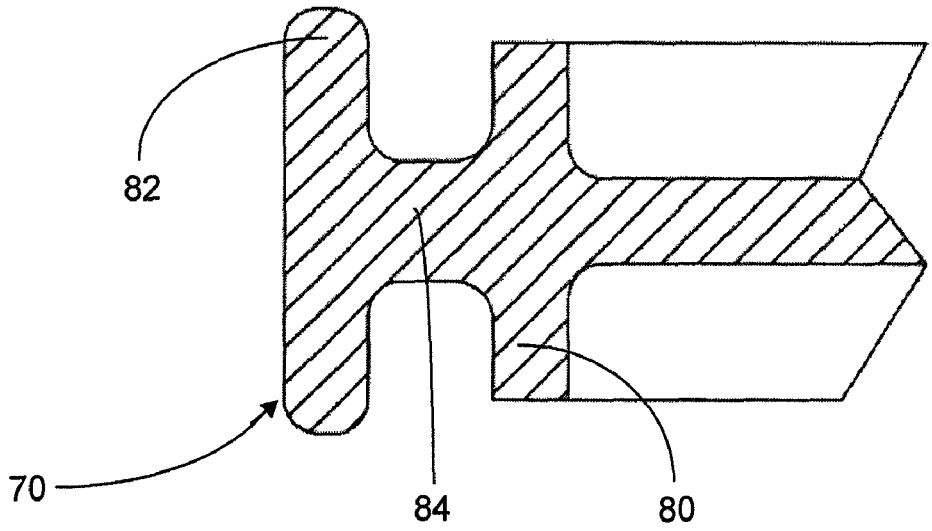
FIG. 8 is a partial sectional view taken along the line 8-8 of FIG. 7.

The tie 60 is shown in a side view in FIG. 7 and attention is drawn to slidable locking means comprising locking tabs or detents 90, 92 at the upper section 74 and lower section 78, respectively, of each of the rails 70,72 . The function of locking tabs 90, 92 are explained in greater detail below.

Figure 9:
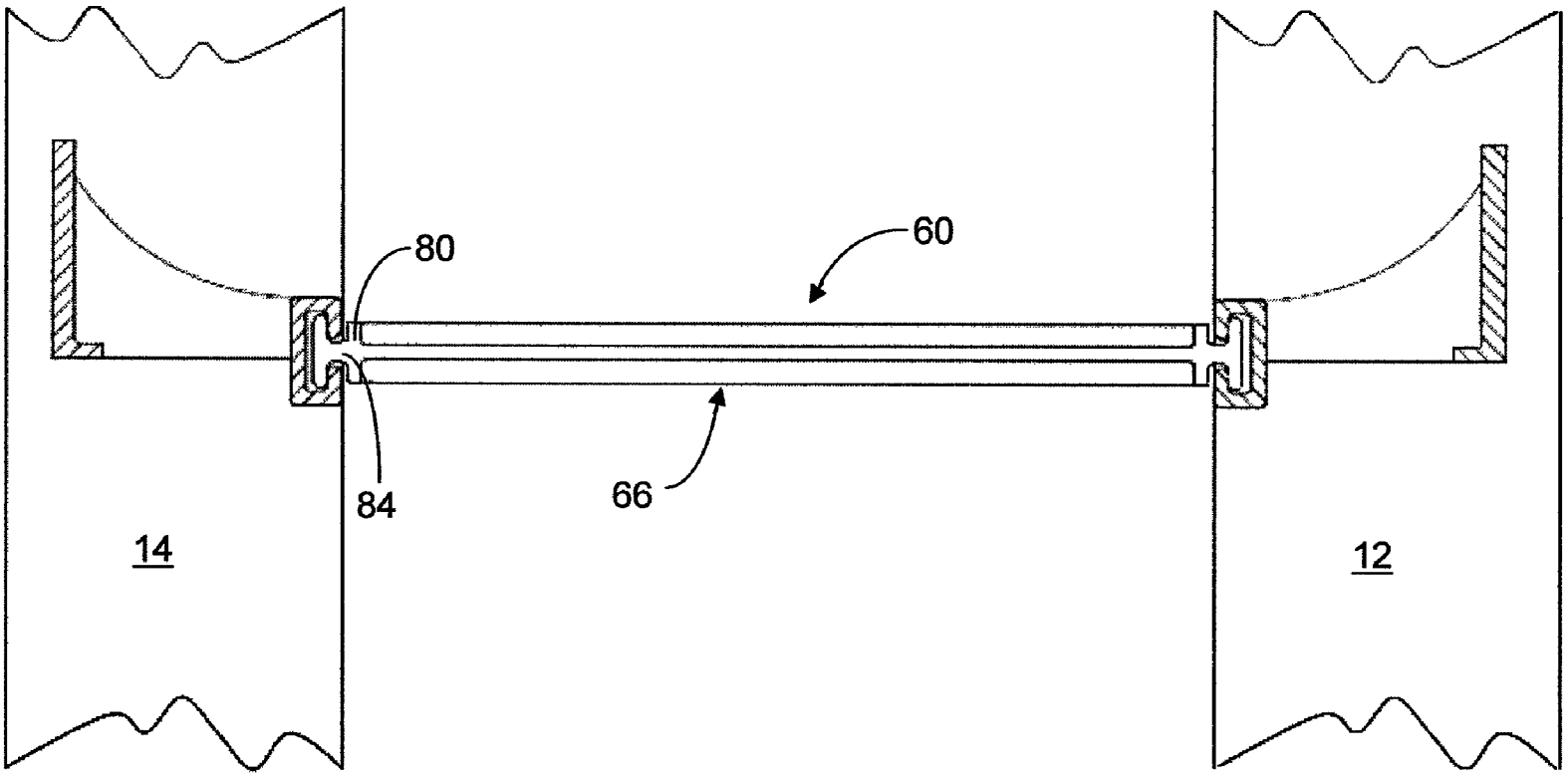
FIG. 9 is a top plan view of the tie assembly including the tie and two anchors.
Figure 10:
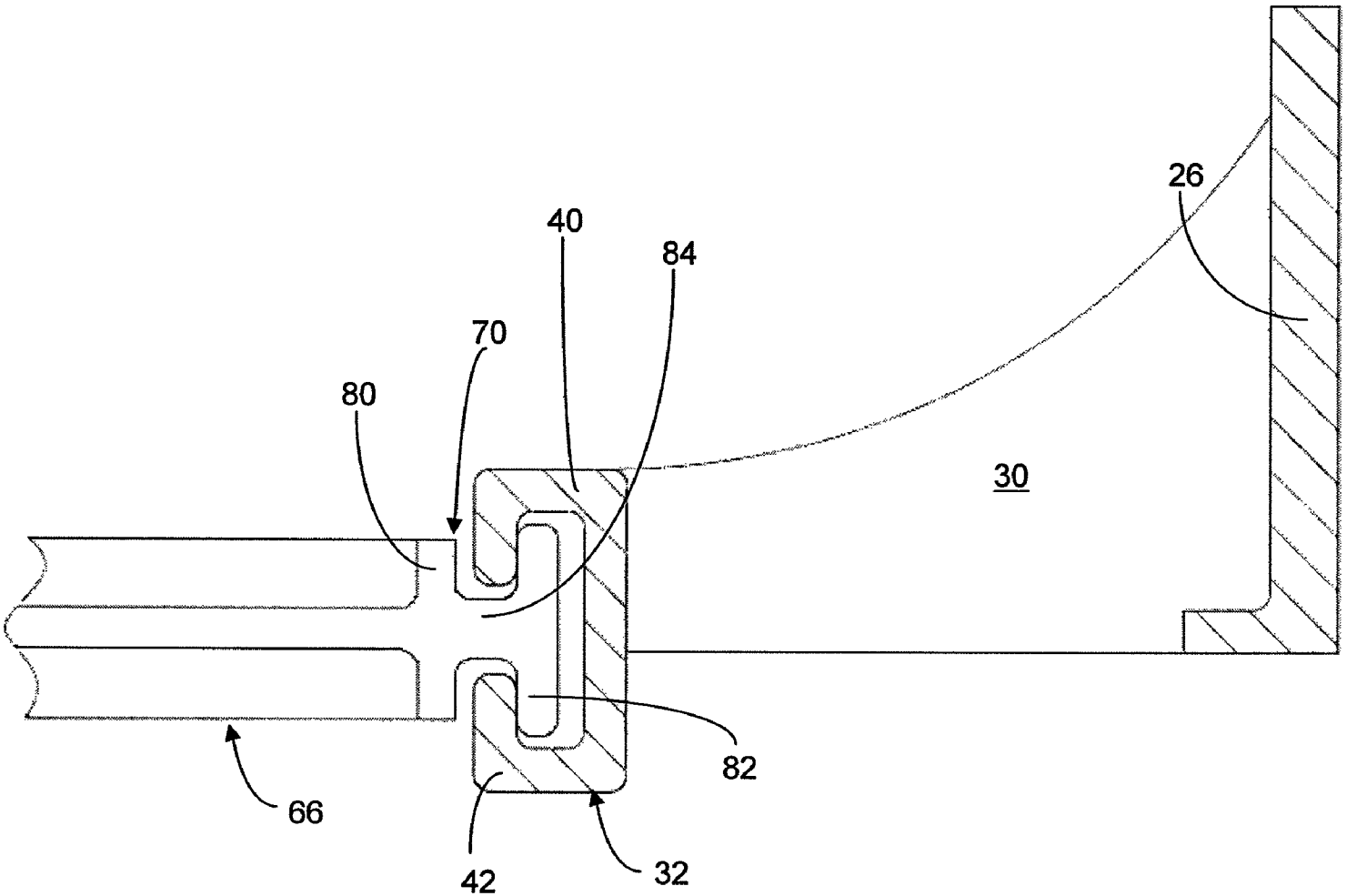
FIG. 10 is an enlarged sectional view of a portion of the tie assembly shown in FIG. 9.

FIGS. 9 and 10 illustrate the engagement of the tie 60 with the anchors 20, 22. Anchors 20, 22 are embedded in panels 14, 12, respectively, such that the opening to the C-channel 32 (the space between the arms 34) is flush with the inner surface of panels 12, 14. As seen best in FIG. 10, the outer runner 82 is inserted into the opening of C-channel 32 and is thus locked in position and resists forces tending to push panels 12, 14 away from one another as is the condition when wet cement is being poured. FIG. 9 also illustrates that the outer surfaces of panels 12, 14 are outwardly spaced from the outer surface of furring strips 25 although as will be apparent to those skilled in the art, the furring strips may be closer to or flush with the outer surface of the panels. As noted earlier, it is desirable that the workmen installing covering on the completed wall can easily identify the position of the furring strips so that a fastener, for example, may be attached through an outer covering to the panel by engaging and piercing the furring strip. For this purpose, if the furring strip is inset from the outer surface of the panel, the panel may be molded so that it has vertical lines 27 that indicate the position of the furring strip beneath the outer surface of the panel. In certain applications, it is desirable that the furring strips be inset from the outer surface of the panel so that when an outer covering is positioned on the panel and a workman drives a fastener through the outer covering and into the furring strip, the panel in the immediate area of the fastener will be slightly compressed and thus provide a resistance force to assure contact between the outer covering and the panel.

Figure 11:
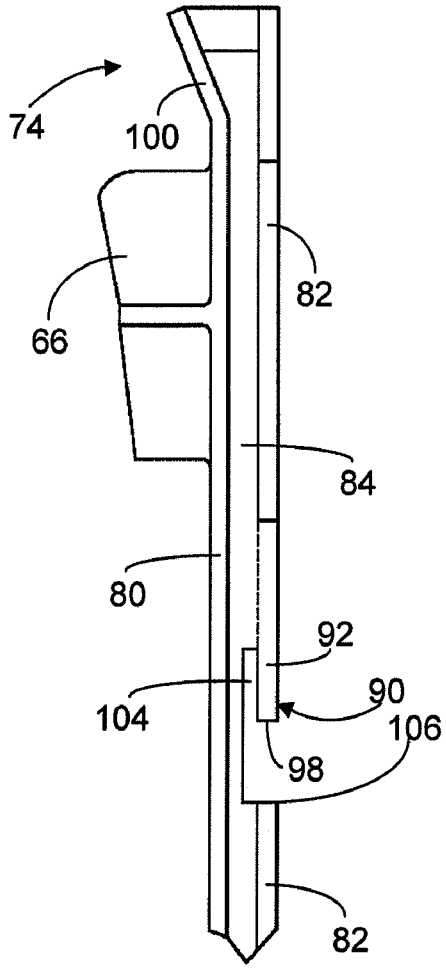
FIG. 11 is an enlarged side elevation view of a portion of the tie shown in FIG. 7.
Figure 12:
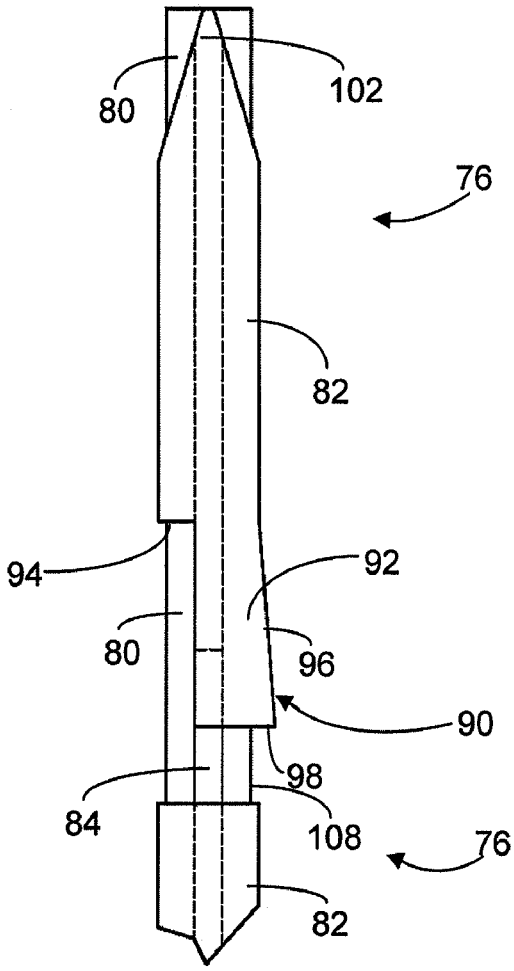
FIG. 12 is a side elevation view of the portion of the tie shown in FIG. 11.

FIGS. 11 and 12 show a portion of the upper section 74 of tie 60. FIG. 11 is a front view of the upper portion of the tie and FIG. 12 is a side elevation view of the portion shown in FIG. 11. In FIG. 11, the top most section of the tie rail is formed so that the inner runner 80 flares toward the center of the panel away from outer runner 82 as shown at 100. As seen in FIG. 12, the portion of outer runner 82, laterally adjacent the flared inner runner 100, is pointed as shown at 102. The purpose of the flare section 100 and pointed section 102 of the inner and outer runners, respectively, is to ease the entry of the rail runner 82 into the C-channel 32 of the anchor.

As indicated earlier, it is desirable that when tie 60 is inserted into the anchors as shown best in FIGS. 1 and 9, the tie may be locked vertically in place so that it does not disengage from the anchors. For this purpose, there is provided means for selectively preventing slidable movement between the tie and anchors. The upper section 74 is identical to the lower section 78 except that the position of the elements are inverted. Referring now to the lower portion of FIGS. 11 and 12, it will be seen that one embodiment of the slidable preventing means comprises a locking tab 90 formed from outer runner 82 that terminates at 94 on one edge of the outer runner while the opposite edge of the runner includes a projection 92 that extends laterally beyond the edge of outer runner 82 and is sloped as shown at 96. Moreover, adjacent the portion of outer runner 92 in the sloped area 96 the web 84 is notched at 104 so that the outer runner portion 92 is cantilevered and is thus free to deflect. The notch 104 removes a portion of web 84 immediately adjacent projection 92 and extending downward so as to terminate at 106 thereby defining an opening 108 in runner 82. This opening also allows outer runner portion 92 to freely deflect.

When assembling tie 60 and the anchors 22, 24, the tip of outer runner 82 of tie 60 is inserted into C-channel 32 at one end. The tie is then slid in the C-channel whereby the sloped portion 96 of locking tab 90 as it passes each C-section 42, 44 is deflected. The locking tab 90 passes the lowest most arm section 42 on the left side of C-channel 32. Simultaneously, the upper locking tab 90 enters the uppermost opening in arm 34 on the right side of C-channel 32. If the tie is then attempted to be removed from the anchors, the edges 98 of tabs 90 will engage the adjacent arm section 42 of the opening 108 and preclude the tie from sliding movement. Thus, the tie is slidably locked in place and when the tie is forced downwardly as will occur when rebar is laid in the notches of the spacing member 66, the load of the rebar will be resisted and will prevent inadvertent movement of the tie relative to the panels making up the form.

It will be understood by those of ordinary skill in the art that the embodiment shown and described utilizes a male engagement element on the tie and a female engagement element in the anchor. However, the male-female relationship could be reversed if so desired. Moreover, while the engagement elements are shaped in cross-section as a "C" and a "T" those skilled in the art will understand that various types of longitudinal engaging elements may be substituted for the "C" and "T" sections. Furthermore, the slidable locking or prevention means is only exemplary of sub-assemblies that may lock the slidable movement of one member relative to another including clips, fasteners, detent devices, glue, magnets or the like.

Figure 13:
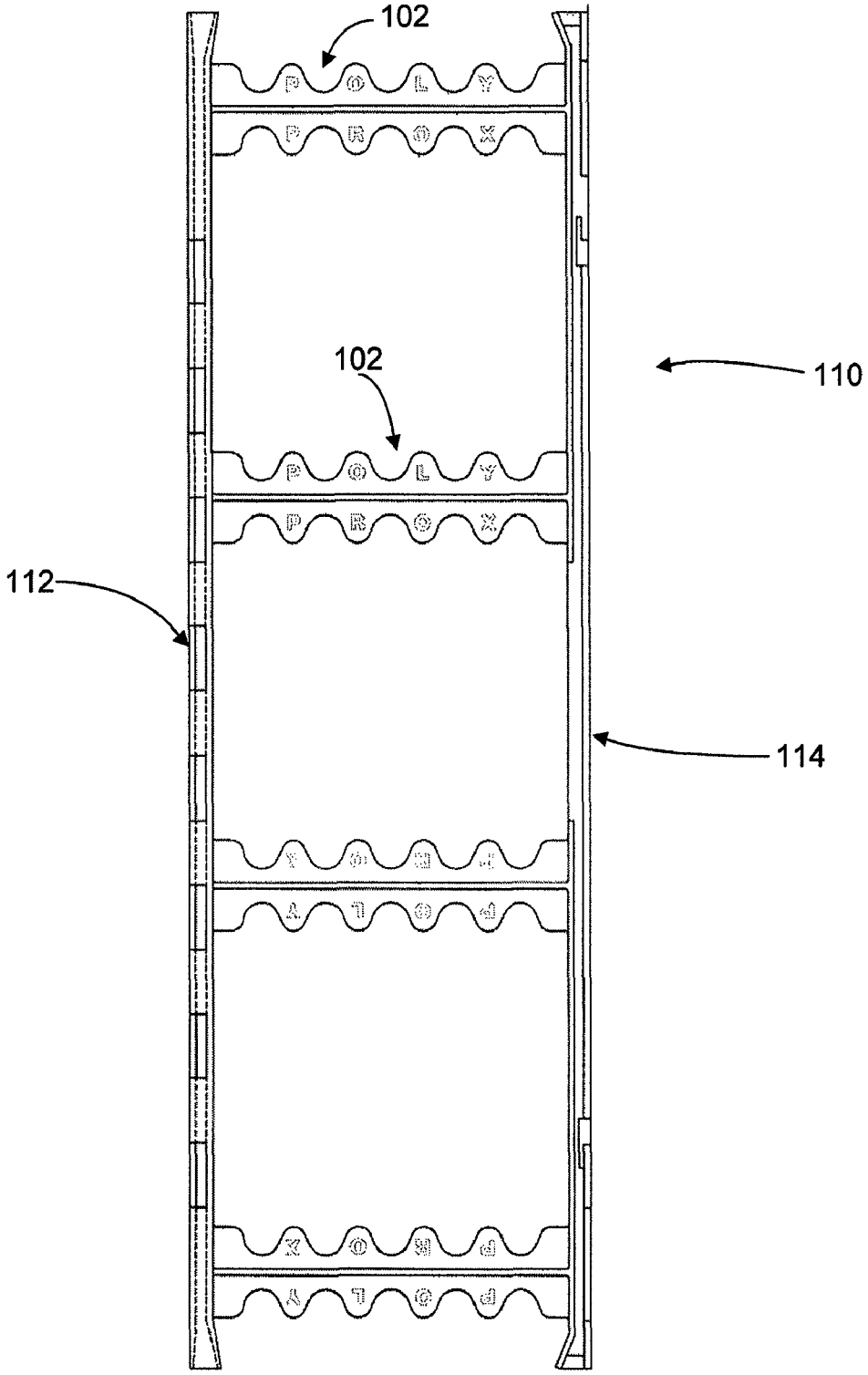
FIG. 13 is a front elevation view of another embodiment of a tie.
Figure 14:
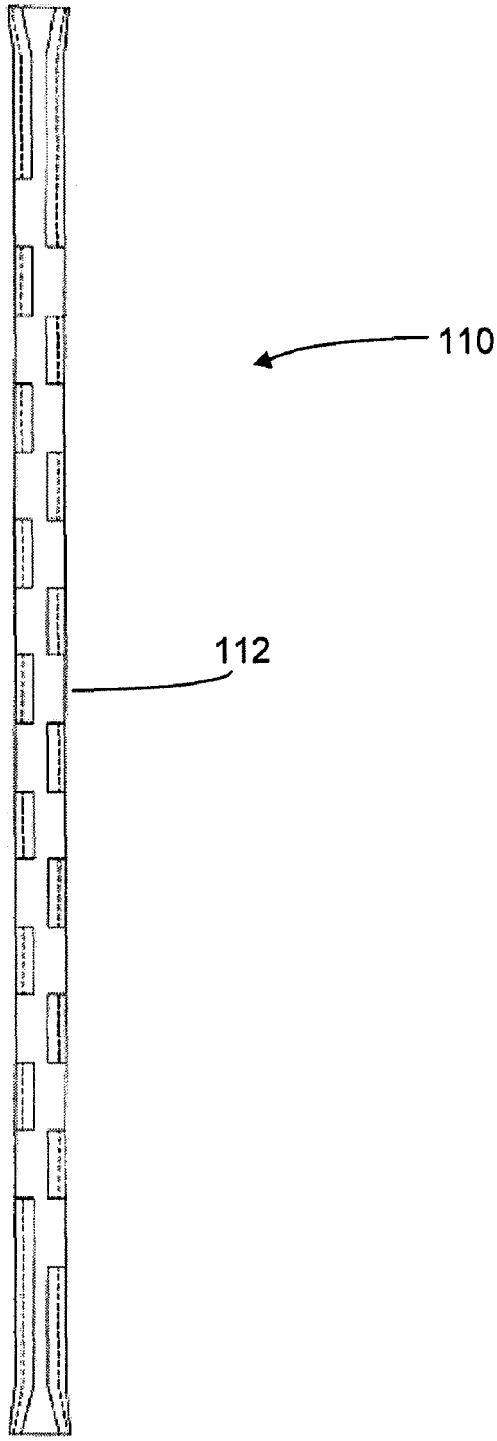
FIG. 14 is a left side elevation view of the embodiment shown in FIG. 13.
Figure 15:
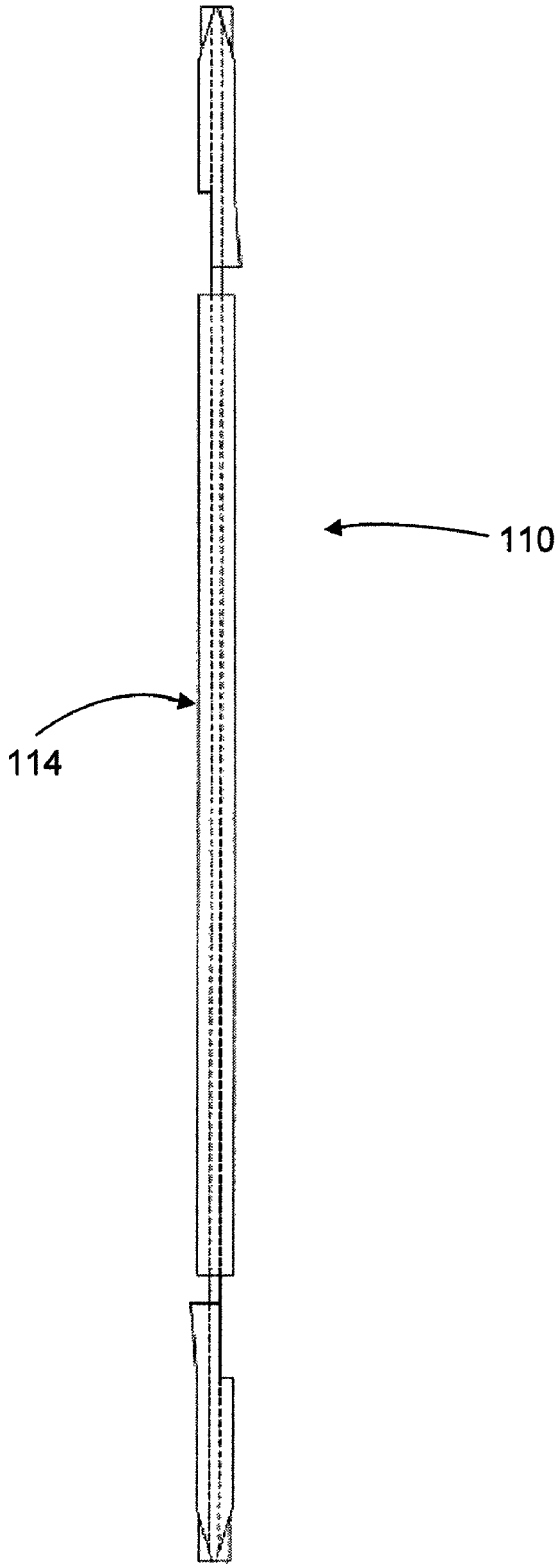
FIG. 15 is a right side elevation view of the tie embodiment in FIG. 13.

It is desirable to have ties that can be used to construct a wall in selected increments from 4-24 inches in thickness. Thus, it is desirable that a tie have a minimum width of 4 inches. Rather than make a tie for each larger thickness of wall, inventory costs may be reduced by a tie embodiment 110 with a male rail on one side and a female anchor at the other side as shown in FIGS. 13, 14 and 15. As seen in FIG. 13, the rail 112 is a female and has the same construction as the engaging member or element 26 of anchor 20 as shown and described in FIGS. 2 and 4. At the other side of the tie extender, there is a standard rail of the type shown in FIGS. 5 and 7. Accordingly, if the extension is 4 inches in width, it may be used together with a standard tie also 4 inches in width to build an 8 inch wall. One 4 inch extender, one 6 inch extender, and one 4 inch tie will build a 14 inch thick wall. It will therefore be appreciated that ties of 4 inch and 6 inch plus extenders of 4 inch and 6 inch will allow the building of a hollow wall in 2 inch increments that may be used to construct walls of from 4 to 24 inches in thickness.

Although the invention has been described in detail with particular reference to the embodiments shown, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. An insulating concrete form comprising:

a pair of wall panels arranged in spaced apart relation, each panel formed of a lightweight insulating material and having interior and exterior surfaces, said internal surfaces being in opposed relation;

at least two vertically disposed tie assemblies each including a pair of vertically elongated anchors, each anchor vertically embedded within one of said panels, each anchor comprising a vertical elongated member having a vertically extending first engagement element positioned so as to be exposed on the interior surface of the panel, and an elongated furring strip positioned within the panel so that the strip is adjacent to the exterior surface of the panel, said vertically extending first engagement element connected to said elongated furring strip by at least one web member;

a vertically extending ladder-like tie including a pair of vertically extending second engagement elements, each second engaging element removably engaging one of said first engagement elements so as to maintain said panels in spaced apart relation; and a slidable locking mechanism to prevent disengagement of the anchor and tie, said slidable locking mechanism including a female engagement element defining one of the first or second engagement elements, said female engagement element having generally C-shaped cross section and elongate opposed sides, each side having staggered openings arranged to be substantially opposed to at least a portion of one of said elongated sides; and a male engagement element defining the other of the first and second engagement elements, said male engagement element including a cantilevered locking tab configured to deflect against the opposed sides, as the cantilevered locking tab is slid into the female engagement element and to lock into place in one of the staggered openings of said female engagement element.

2. The insulating concrete form of claim 1 wherein said first engagement element is said female engagement element which further comprises a C-shaped channel having a slot exposed on said panel interior surface and said second engagement element is said male engagement element which further includes an elongated T-shaped runner slidably inserted into said C-shaped slot so as to prevent lateral movement of said panels.

3. The insulating concrete form of claim 1 wherein said web member comprises at least two horizontally disposed webs permanently interconnecting said vertically extending first engagement element and said elongated furring strip at two vertically spaced apart locations.

4. The insulating concrete form of claim 1 wherein said furring strip is embedded within said panel adjacent said exterior panel surface.

5. The insulating concrete form of claim 1 wherein said panel material is expanded polystyrene.

6. The insulating concrete form of claim 1 wherein each said panel has an upper and lower edge and each said anchor is substantially equal in length to the distance between the upper and lower edges of said panel.

7. The insulating concrete form of claim 6 wherein said second engagement element length is approximately equal to the height of said anchor.

8. The insulating concrete form of claim 1 wherein the panels with integral anchors and the tie are shipped in "knocked-down" form and assembled on site.

9. An insulating concrete form, comprising a pair of spaced apart insulating panels, a plurality of said forms adapted for assembly into a hollow wall that may be filled with concrete to provide a permanent wall comprising concrete and insulating panels, said panels having interior and exterior surfaces and arranged so that said interior surfaces are maintained in opposed spaced apart relation by at least two tie assemblies, each tie assembly including a pair of elongated anchor members, each anchor member attached to one of said panels in opposed relationship, each anchor member including an engaging element accessible from said panel interior which is connected to an elongated furring strip disposed adjacent said panel exterior surface, and an elongated rectangular tie having engaging elements along each edge for selectively interconnecting said anchor member engaging elements and maintaining said panels in spaced apart relation;

the insulating concrete form additionally comprising a slidable locking mechanism to prevent disengagement of the anchor and tie, said slidable locking mechanism including a female engagement element defining the engaging elements of one of the anchors or tie, said female engagement element having generally C-shaped cross section and elongate opposed sides, each side having staggered openings arranged to be substantially opposed to at least a portion of one of said elongated sides; and a male engagement element defining the engaging elements of the other of the anchors or tie, said male engagement element including a cantilevered locking tab configured to deflect against the opposed sides, as the cantilevered locking tab is slid into the female engagement element and to lock into place in one of the staggered openings of said female engagement element.

10. The insulating concrete form of claim 9 wherein said vertically elongated rectangular tie is a ladder-like structure comprising a pair of spaced apart rails each supporting one of said engagement elements and at least two horizontal cross members interconnecting said rails.

11. The insulating concrete form of claim 10 wherein each of said cross member includes at least one notch or depression for supporting a rebar.

12. The insulating concrete form of claim 9 wherein said anchor member engaging element is said female engagement element which further comprises a C-shaped channel and said tie engaging elements are said male engagement elements which further comprise comprise T -shaped members, said T-shaped member slidably received in said C-shaped channel.

13. The insulating concrete form of claim 12 wherein said elongated anchor member C-shaped channel ends are shaped to facilitate slidable entry of an end of said T-shaped member into said channel.

14. An insulating concrete form comprising:

a pair of rectangular, lightweight insulating panels arranged in spaced apart relation to define an inner space;

a tie assembly comprising a pair of anchors and a tie;

each of said anchors comprising an elongated C-shaped cross-section channel attached to one of said insulating panels and exposed to the inside space between the two panels and an elongated furring strip connected to said C-channel; and said tie comprising a pair of rails each including an elongated runner having a T-shaped cross-section insertable into said C-channel, said rails interconnected by spacing members;

wherein each C-channel includes elongate opposed sides, each side having staggered openings arranged to be substantially opposed to at least a portion of one of said elongated sides;

and wherein each runner includes a cantilevered locking tab configured to deflect against the opposed sides, as the cantilevered locking tab is slid into its corresponding C-shaped channel and to lock into place in one of the staggered openings of the C-shaped channel to prevent relative movement between said tie and anchors.

15. The insulating concrete form of claim 14 wherein the ends of said C-channels are widened to permit easy entry of the tie elongated runner.

16. The insulating concrete form of claim 14 wherein the ends of the elongated runners are pointed to permit easy entry into the C-shaped channels.

* * * * *